US011834262B2

(12) United States Patent
Zhou

(10) Patent No.: US 11,834,262 B2
(45) Date of Patent: Dec. 5, 2023

(54) KITCHEN GARBAGE CAN

(71) Applicant: Zhejiang Erhui Technology Co., Ltd., Taizhou (CN)

(72) Inventor: Jian-Hua Zhou, Taizhou (CN)

(73) Assignee: Zhejiang Erhui Technology Co., Ltd., Taizhou (CN)

( * ) Notice: Subject to any disclaimer, the term of this patent is extended or adjusted under 35 U.S.C. 154(b) by 182 days.

(21) Appl. No.: 17/604,342

(22) PCT Filed: Mar. 12, 2020

(86) PCT No.: PCT/CN2020/078957
§ 371 (c)(1),
(2) Date: Oct. 15, 2021

(87) PCT Pub. No.: WO2020/224324
PCT Pub. Date: Nov. 12, 2020

(65) Prior Publication Data

US 2022/0212865 A1 Jul. 7, 2022

(30) Foreign Application Priority Data

May 9, 2019 (CN) ..... 201910383538.8

(51) Int. Cl.
*B65D 43/20* (2006.01)
*B65F 1/16* (2006.01)
*B65F 1/14* (2006.01)

(52) U.S. Cl.
CPC ..... *B65F 1/1623* (2013.01); *B65F 1/141* (2013.01); *B65F 1/1646* (2013.01)

(58) Field of Classification Search
CPC ..... B65F 1/1623; B65F 1/141; B65F 1/1646; B65F 1/006; B65F 2001/1669; B65D 43/20; B65D 43/24
USPC ..... 220/908, 263, 817, 811, 812, 815
See application file for complete search history.

(56) References Cited

U.S. PATENT DOCUMENTS 2,850,760 A * 9/1958 Vanderwalker ..... B65F 1/1646 220/817
6,793,084 B1 * 9/2004 Wunsch ..... B65F 1/1615 220/323
7,010,833 B2 * 3/2006 Duarte ..... E05D 3/022 16/362
7,506,902 B2 * 3/2009 Sheng ..... G03G 21/1666 292/133
8,655,227 B2 * 2/2014 Nishimura ..... H04N 1/00554 399/125
9,004,546 B2 * 4/2015 Dunstan ..... E05D 15/582 109/70

(Continued)

*Primary Examiner* — John K Fristoe, Jr.
*Assistant Examiner* — Elizabeth J Volz
(74) *Attorney, Agent, or Firm* — Chun-Ming Shih; HDLS IPR SERVICES

(57) ABSTRACT

Provided is a kitchen garbage can; the upper edge of the garbage can is equipped with a side slide can cover; when the can lid (2) is opened, it slides along the sides of the opening to the outer side wall of the garbage can; when opened and closed, the lid is only slightly higher than the top of the garbage can body; as a rear-hung garbage can, it does not affect the normal operation of the kitchen countertop when hung near the countertop, and may also be placed on the floor and used as an ordinary garbage can; the garbage can has the features of a reasonable structure, convenience and hygiene.

10 Claims, 8 Drawing Sheets

(56) References Cited

U.S. PATENT DOCUMENTS

2005/0230396 A1* 10/2005 Yang ..... B65F 1/163
220/264

* cited by examiner

KITCHEN GARBAGE CAN

TECHNICAL FIELD

The present invention relates to a garbage bin, more specifically to one kind of damping side sliding style garbage can.

BACKGROUND

Garbage cans are commonly used sanitary utensils in people's daily life. There are many types of garbage cans, and at the same time, the size and opening and closing methods are also different: currently some kitchen garbage cans are used to collect food waste and utilize a back-hanging structure, and the garbage can is directly hung on the door frame of the kitchen cabinet using a hook. The upper edge of the garbage can is close to the kitchen countertop, and it is inconvenient to configure the garbage can lid with the upper edge. Once the lid is set, when the lid is opened, the lid will rise a lot above the countertop, which will affect normal operation. Therefore, current kitchen hanging frame type garbage cans are generally not equipped with lids, and open garbage cans are not sanitary, easily spreading odors, which need to be dealt with in time.

SUMMARY

The following technical solutions are utilized to achieve the above-mentioned purpose:

A kitchen garbage can, comprising a garbage can body, which is characterized in that: a lid is arranged on the top opening of the garbage can body, the lid matching the shape of the top opening, and a side sliding mechanism connecting the lid to the garbage can body, the side sliding mechanism including a long rocker arm and a short rocker arm, with one end of the short rocker arm connectively hinged at the top opening of the garbage can body, a groove is arranged on the bottom of the lid, a slider is arranged on the other end of this short rocker arm, the slider accommodated in this groove, the length of this short rocker arm ensuring that when the lid is opened or closed, as the slider slides in the groove, the bottom of the moving lid is always close to one side of the short rocker arm arranged on the top opening of the garbage can body;

one end of the long rocker arm connectively hinged at the top opening of the garbage can body, the other end of the long rocker arm connectively hinged to the lid of the garbage can, and the rotation of the long rocker arm and the short rocker arm parallel to the direction of the groove.

The shape of the top opening is square, the short rocker arm connectively hinged to the side wall on the front of this top opening or connectively hinged to both the left and right sides close to the front side wall, the direction of the groove is forward and backward, and the lower end of the long rocker arm connectively hinged to the side walls of the middle of the left and right sides of the top opening, and the upper end of the long rocker arm connectively hinged to the lid near the middle and rear or rear ends of the left and right edges.

The garbage can body including an outer casing, an inner casing and an upper frame, the inner casing is accommodated in the outer casing, the upper frame is arranged at the top opening of the outer casing, one end of the short rocker arm connectively hinged to the front part of the upper frame, the lower end of the long rocker arm connectively hinged to the middle of the upper frame on both the left side and right side.

Connecting parts are arranged at the lower part of the left and right inner sides of the upper frame, and a step portion is formed between the top of the connecting part and the left and right inner side walls of the upper frame, and this step portion is provided with a guiding groove that penetrates the top surface of the connecting part, the lower end of the long rocker arm passes through the guiding groove and is pivotally connected to the connecting part.

The lower end of the long rocker arm is provided with a gearwheel, and the long rocker arm is pivotally connected to the connecting part through a gear shaft of the gearwheel, and a damping gear with gear meshing is pivotally connected to the connecting part.

A reset connection part is also arranged on the lower end of this long rocker arm, and a tension spring is arranged between the reset connection part and the upper frame, the tension spring providing a moving force when the lid is closed.

A reset connecting part is arranged on the lower end of the long rocker arm, and the reset connecting part is arranged on the left or right side of the gearwheel, a tension spring is set between the reset connection part and the upper frame, and the tension spring providing the moving force when the lid is closed.

The outer body includes a base and a cover, the cover is arranged on the base, and the upper frame is set on the top opening of the cover.

A side sliding control part is arranged on the top of the lid.

A hanging board is also arranged on the outside of the garbage can body.

DETAILED DESCRIPTION

Figure 1:
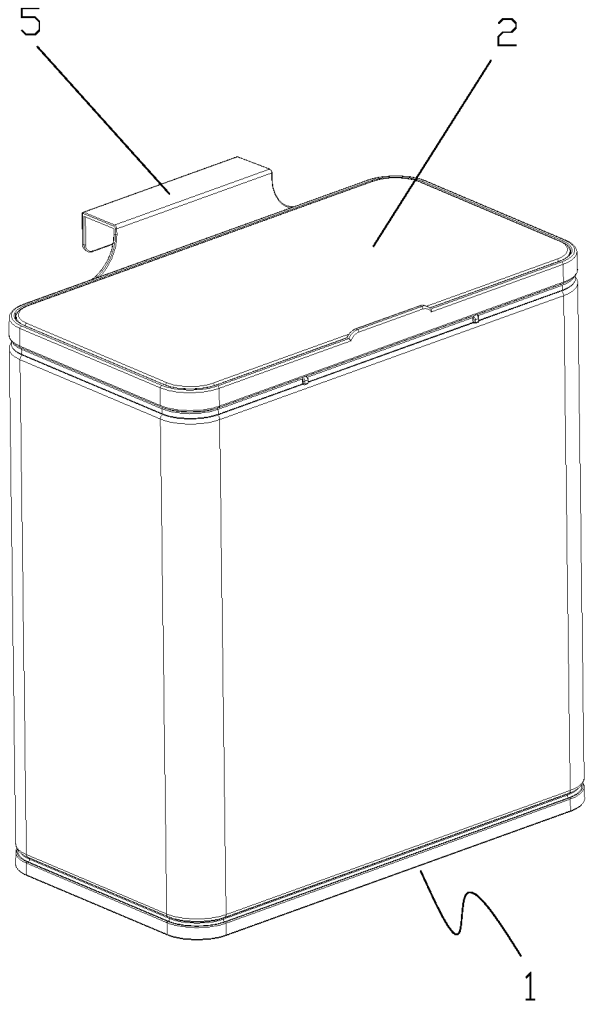
FIG. 1 is a schematic structural diagram of the present invention.
Figure 2:
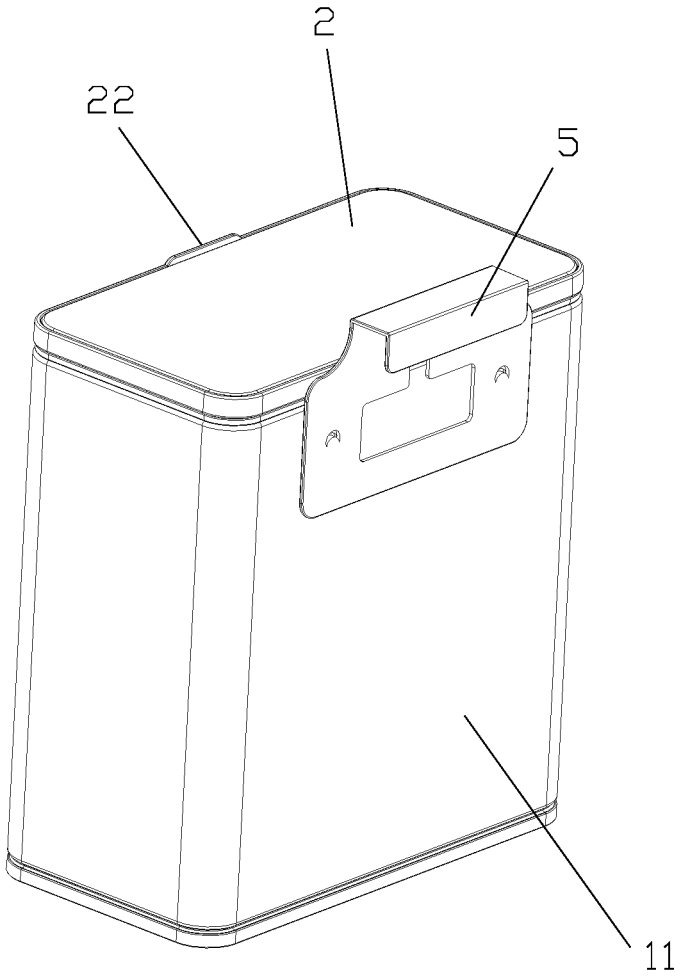
FIG. 2 is a schematic structural view of the back of the present invention.
Figure 3:
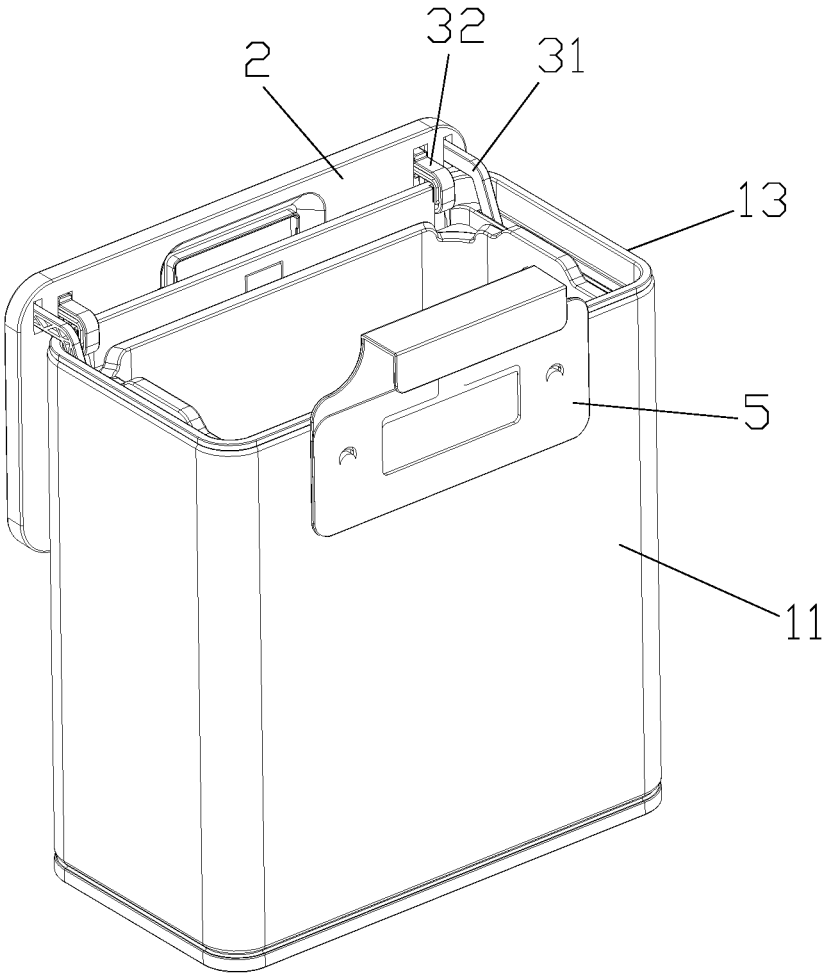
FIG. 3 is a schematic structural diagram of the lid in an open state of the present invention.
Figure 4:
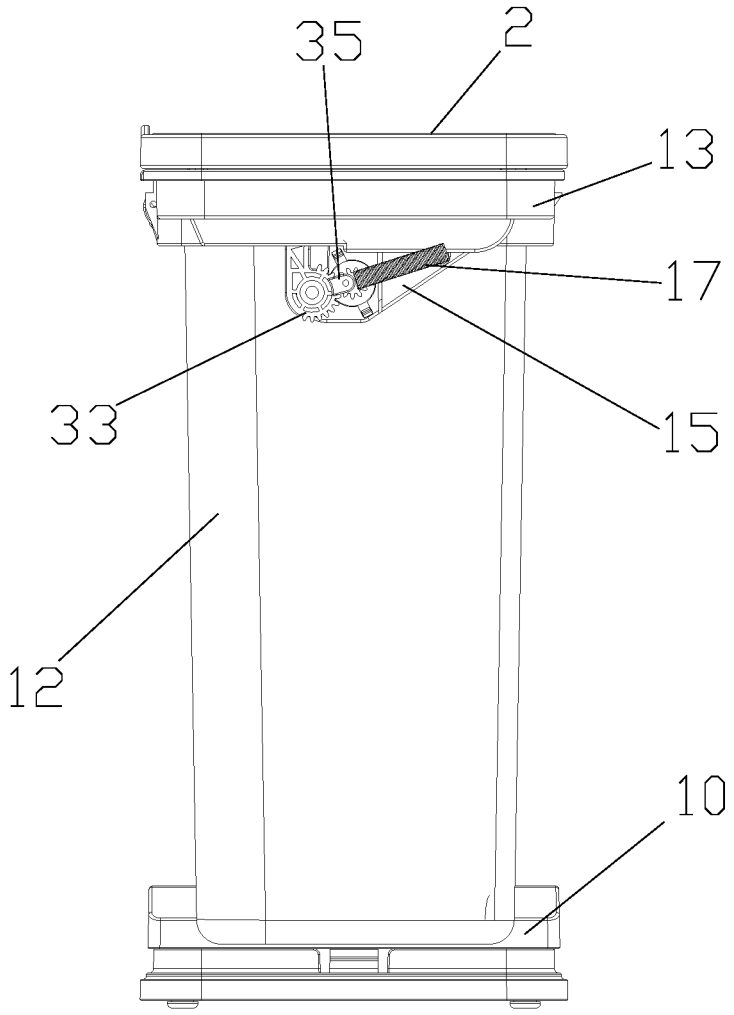
FIG. 4 is a schematic structural diagram of the side sliding mechanism when the lid of the present invention is closed.
Figure 5:
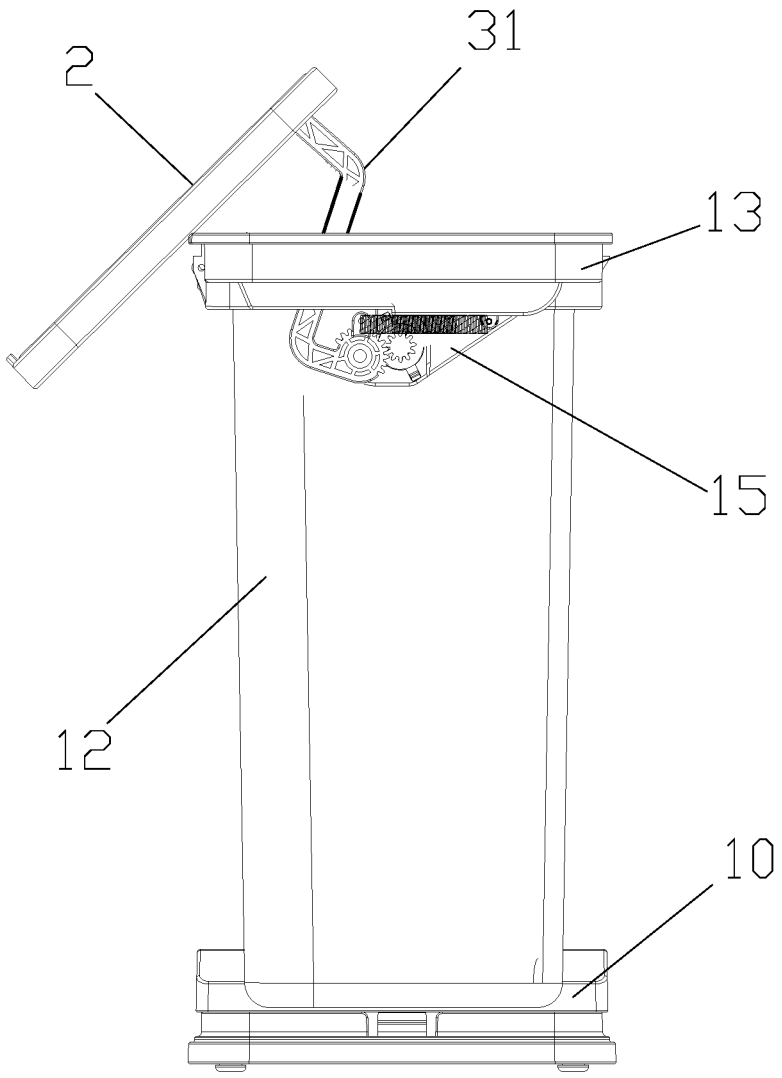
FIG. 5 is a schematic diagram of the structure of the side sliding mechanism during the opening of the lid of the present invention.
Figure 6:
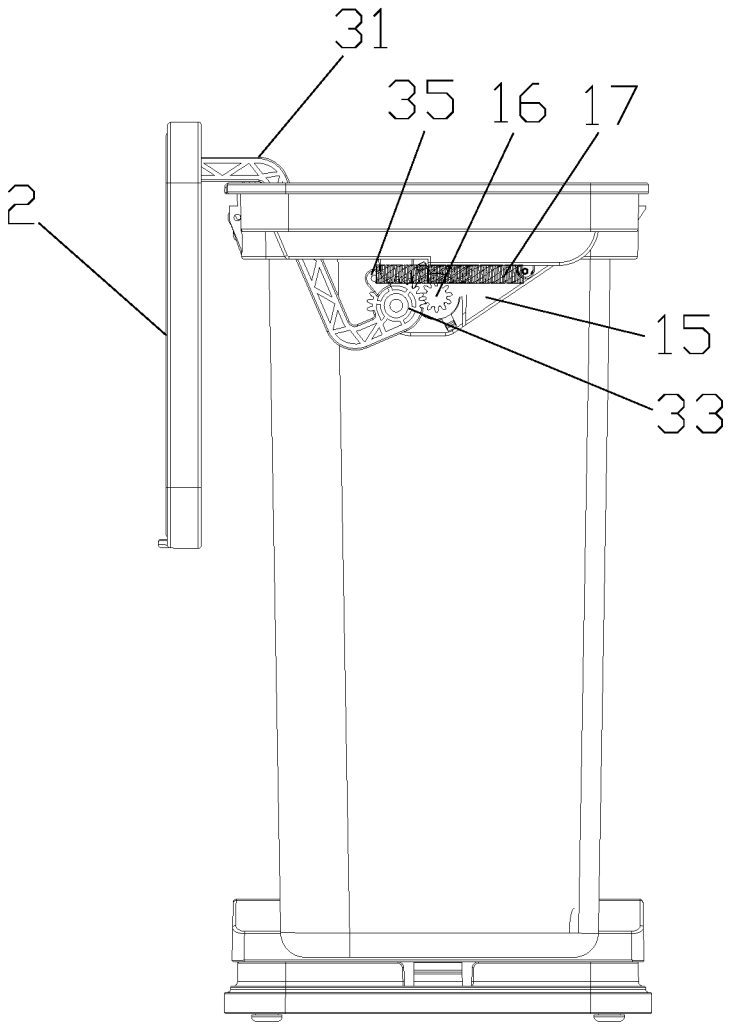
FIG. 6 is a structural schematic diagram of the side sliding mechanism after the lid is fully opened in the present invention.
Figure 7:
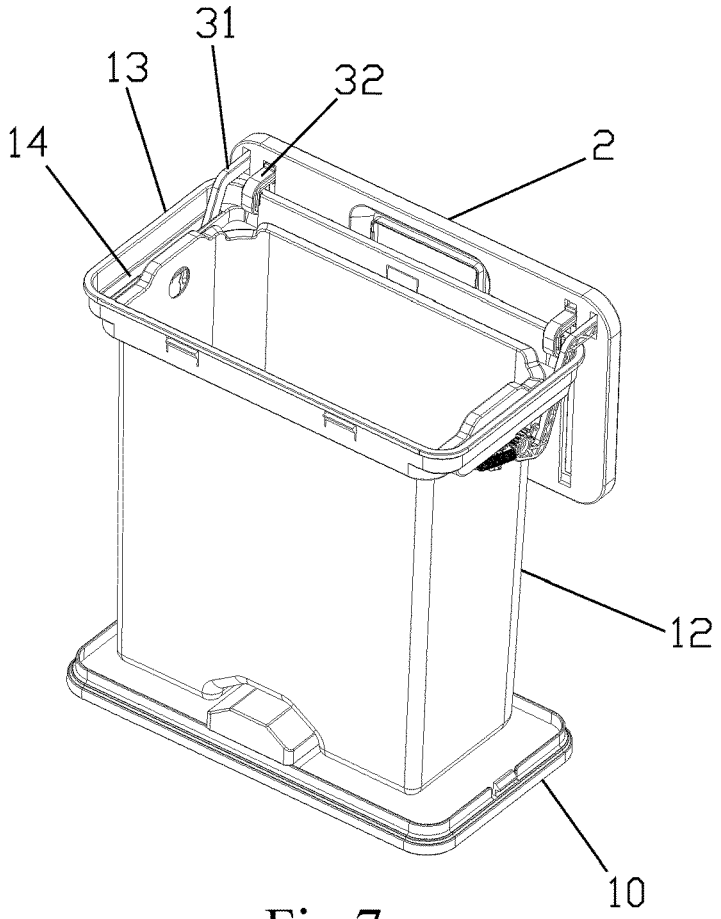
FIG. 7 is a three-dimensional schematic diagram of the internal structure after the lid is opened of the present invention.
Figure 8:
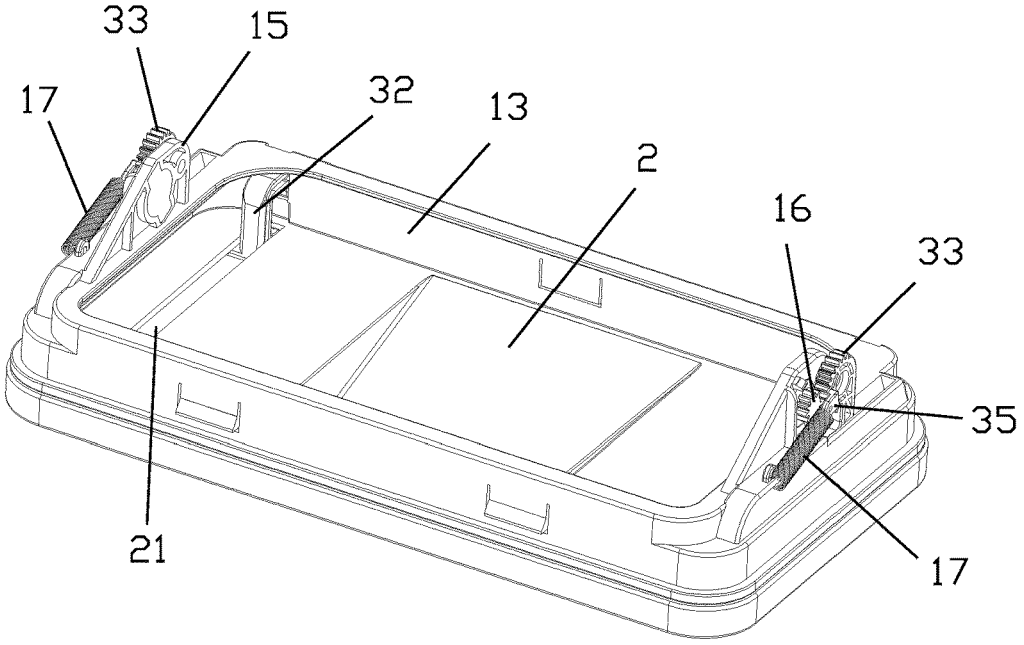
FIG. 8 is a schematic diagram of the lid and the upper frame of the present invention.
Figure 9:
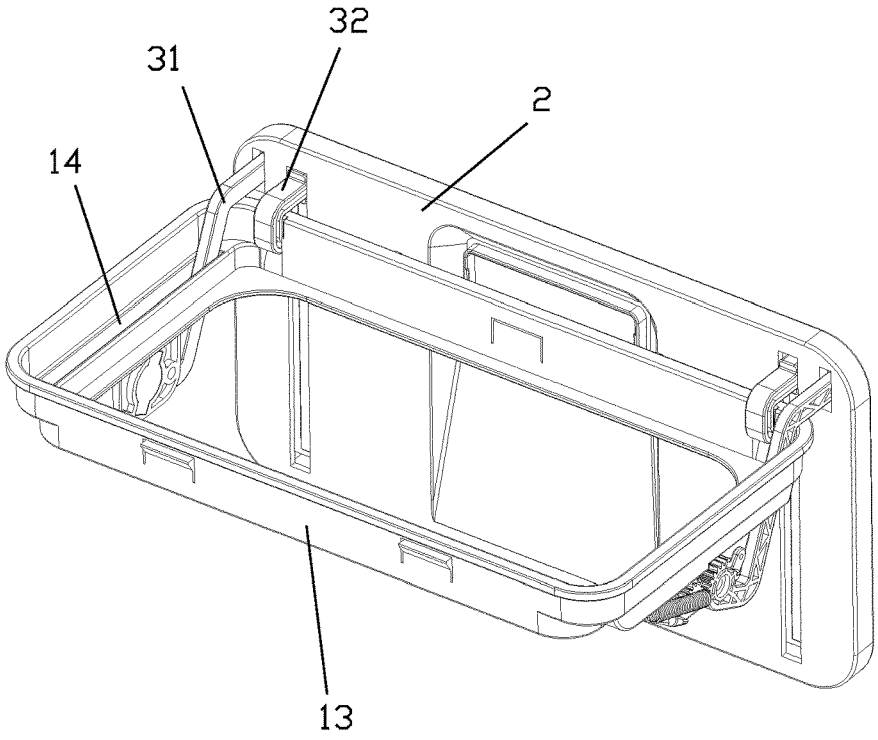
FIG. 9 is a schematic diagram of the open state of the lid and the upper frame of the present invention.
Figure 10:
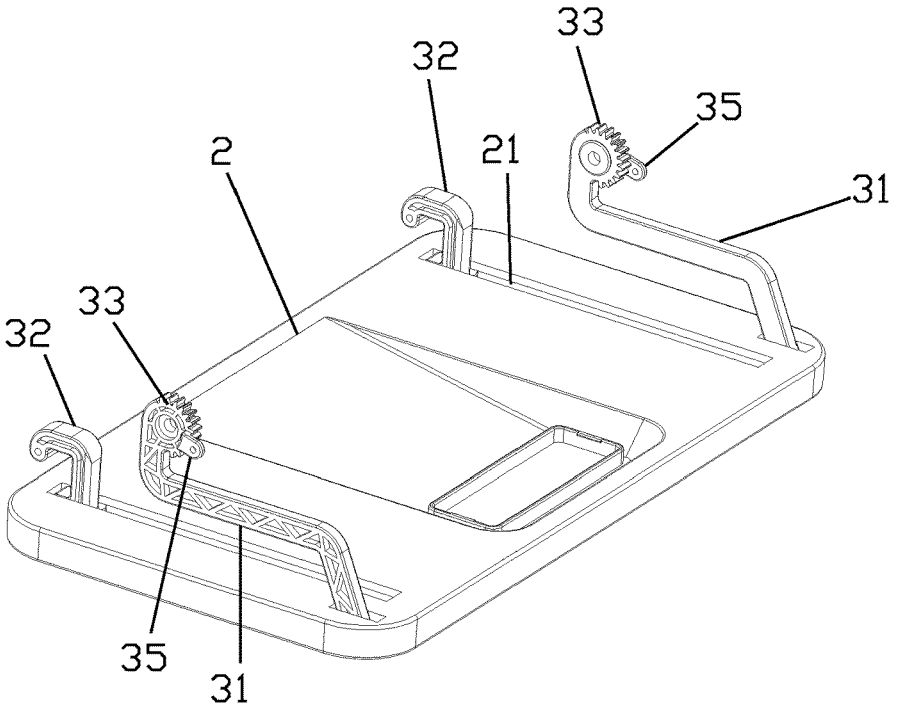
FIG. 10 is a schematic diagram of the cooperation between the lid and the side sliding mechanism of the present invention.

As shown in FIGS. 1-10, a kitchen garbage can including a garbage can body 1, the garbage can body 1 including an outer casing, an inner casing 12 and an upper frame 13, this inner casing 12 is accommodated in this outer casing, the outer casing including a base 10 and a cover 11, the cover 11 is placed on this base 10, and the upper frame 13 is set on the top opening of the cover 11, a lid 2 arranged on the top end of the garbage can body 1, the garbage can lid 2 connecting to the upper frame through a side sliding mechanism, a side sliding operating part 22 is arranged on the top of the lid 2, a hanging board 5 is arranged on the outer side of the garbage can body 1.

This top opening is square shaped, and the upper frame 13 is symmetrical with the top opening and also has a square shaped structure, the side sliding mechanism including a long rocker arm 31 and a short rocker arm 32, one end of the short rocker arm 32 connectively hinged to an upper side wall on the front of the upper frame 13, a groove 21 is arranged on the bottom of the lid 2, the direction of allowable movement of the groove 21 is forwards and backwards, a slider is arranged on the other side of the short rocker arm 32, the slider is accommodated inside groove 21, the length of the short rocker arm 32 ensures that when lid 2 is opened or closed, as the slider slides in the groove 21, the bottom of the moving lid 2 is always close to one side of the short rocker arm 32 arranged on the top opening of garbage can body 1; a connecting part 15 is arranged on the bottom left and right inner walls of the upper frame, the top of the connecting part 15 forming a step portion between the left and right inner walls of the upper frame, and the step portion is provided with a guiding groove 14 that penetrates the top surface of the connecting part, the bottom end of the long rocker arm 31 penetrates the guiding groove 14 and pivots on connecting part 15; a gear wheel 33 is arranged on the bottom end of long rocker arm 31, and long rocker arm 31 is pivotally connected to the connecting part 15 through the gear shaft of the gear wheel 33, the connecting part 15 is pivotally connected to a damping gear 16 meshed with gear wheel 33, a reset connection part 35 is arranged on the lower end of this long rocker arm 31, this reset connection part 35 is arranged on the left side or right side of gear wheel 33, and a tension spring 17 is arranged between reset connection part 35 and upper frame 13, the tension spring 17 providing the moving force when the lid 2 is closed, the top end of this long rocker arm 31 is connectively hinged near the back of lid 2; the rotation plane of long rocker arm 31 and this short rocker arm 32 is parallel with this groove 21.

The present invention has a side sliding structure lid arranged on the top opening of the back-hung kitchen garbage can, when the lid is opened, a force exerted manually by hand on the slide sliding control part 22, will move the lid 2 forward and out, and long rocker arm 31, having gear wheel 33 centered on the gear shaft, rotates lid 2 forward, the short rocker arm 32 slides along groove 21 at the bottom of lid 2, so that lid 2 rotates forward and at the same time the front end of lid 2 always slides close to the front side of the upper frame, and when the lid is opened and in place, lid 2 is suspended at the top opening by the long rocker arm and the short rocker arm, and the bottom surface of the lid will be close to the outer wall of the front side of the garbage can body, and will not affect normal operation of the kitchen countertop; when closing the lid 2, it's only possible to push lid 2 upwards, and one side of the lid 2 is close to the front edge of the top opening and slides upwards while rotating with the gear shaft as the center, and as the gear wheel meshes with the damping gear, after the lid is pushed up a distance, the force exerted on the tension spring 17 arranged between the reset connection part 35 and the upper frame 13, can be slowly eased and reset.

The lid of this present invention has a side sliding opening structure, the lid is pulled in an outward direction when opening, the lid will stay close to the front of the top opening and will rotate and slide to open, and during the opening process the lid will not protrude above the kitchen countertop, and in the final state the lid will be suspended vertically at the front wall of the garbage can body, so as not to affect the normal disposal of kitchen waste, and when pushing up the lid when closing, after pushing up a distance, the lid is automatically reset under the action of the tension spring, and the damping gear is activated, when opening and closing, the speed of the lid can be slowed down, so that it can be opened or closed slowly and at a uniform speed, and this structure is a reliable structure, convenient and hygienic.

What is claimed is:

1. A kitchen garbage can, comprising a garbage can body, further comprising:

a lid set on a top opening of the garbage can body, the lid matching the shape of the top opening, the lid and the garbage can body connected by a side sliding mechanism, the side sliding mechanism including a long rocker arm and a short rocker arm, one end of the short rocker arm connectively hinged to the top opening of the garbage can body;

a groove arranged on the bottom of the lid;

a slider arranged on the other end of the short rocker arm, the slider accommodated in the groove, the short rocker arm ensuring that when the lid is opened or closed, as the slider slides in the groove, the bottom of the moving lid is always close to one side of the short rocker arm arranged on the top opening of the garbage can body, and one end of the long rocker arm connectively hinged to the top opening of the garbage can body, and the other end of the long rocker arm connectively hinged to the lid.

2. The kitchen garbage can according to claim 1, wherein: the top opening is square shaped, one end of the short rocker arm is connectively hinged to the side wall of the front of the top opening or on the left and right sides close to the front side wall, the direction of the groove is forward and backward, and the lower end of the long rocker arm is connectively hinged to the side wall in the middle of the left and right sides of the top opening, the upper end of the long rocker arm connectively hinged to the middle rear or rear end of the lid near the left and right edges.

3. The kitchen garbage can according to claim 2, wherein the garbage can body comprises an outer body, an inner casing and an upper frame, and the inner casing accommodated in the outer casing body, the upper frame is sleeved on the top opening of the outer casing body, one end of the short rocker arm connectively hinged to the front of the upper frame, the lower end of the long rocker arm connectively hinged to the middle of the left and right sides of the upper frame.

4. The kitchen garbage can according to claim 3, wherein a connecting part is arranged at the lower part of the left and right inner sides of the upper frame, between the top surface of the connecting part and the left and right inner side walls of the upper frame a step portion is formed, the step portion comprising a guiding groove penetrating the top surface of the connecting part, and the lower end of the long rocker arm passes through the guiding groove and pivotally connected to the connecting part.

5. The kitchen garbage can according to claim 4, wherein the lower end of the long rocker arm comprises a gear wheel, the long rocker arm passing through the gear shaft of the gear wheel and pivotally connecting to the connecting part, and a damping gear meshing with the gear wheel and pivotally connected to the connecting part.

6. The kitchen garbage can according to claim 5, wherein the lower end of the long rocker arm also comprises a reset connection part, the reset connection part is arranged on the left or right side of the gear wheel, a tension spring is arranged between the reset connection part and the upper frame, the tension spring providing the driving force when the lid is closed.

7. The kitchen garbage can according to claim 4, wherein the lower end of the long rocker arm comprises a reset connection part, a tension spring is arranged between the reset connection part and the upper frame, the tension spring providing the driving force when the lid is closed.

8. The kitchen garbage can according to claim 3, wherein the outer casing body comprises a base and a cover, the cover is placed on the base, and the upper frame is set on the top opening of the cover.

9. The kitchen garbage can according to claim 1, wherein a hanging board is arranged on the outside of the garbage can body.

10. The kitchen garbage can according to claim 9, wherein a side sliding control part is arranged on the top of the lid.

* * * * *